US005970768A

United States Patent [19]

Killop et al.

[11] Patent Number: 5,970,768

[45] Date of Patent: Oct. 26, 1999

[54] MACHINE BASE FOR SUPPORTING VERTICAL MOVEMENT OF FORMING RACKS FOR ROLLING POWER TRANSMISSION FORMATIONS

[75] Inventors: James Thomas Killop, Warren; Robert E. Roseliep, Grosse Pointe, both of Mich.

[73] Assignee: Utica Enterprises, Inc., Shelby Township, Mich.

[21] Appl. No.: 09/093,452

[22] Filed: Jun. 8, 1998

[51] Int. Cl.[6] ..... B21H 5/00

[52] U.S. Cl. ..... 72/88

[58] Field of Search ..... 72/88, 90, 455; 384/50, 53, 55, 56, 58

[56] References Cited

U.S. PATENT DOCUMENTS

| | | | |
|---|---|---|---|
| 432,164 | 7/1890 | McGinnis | 72/88 |
| 3,214,951 | 11/1965 | McCardell | 72/88 |
| 3,303,682 | 2/1967 | Allured | 72/430 |
| 3,793,866 | 2/1974 | Anderson et al. | 72/88 |
| 3,913,476 | 10/1975 | Maquiqnaz | 72/88 |
| 4,095,446 | 6/1978 | Zabava | 72/442 |
| 4,155,236 | 5/1979 | Jungesjo | 72/88 |
| 4,384,466 | 5/1983 | Jungesjo | 72/88 |
| 4,519,231 | 5/1985 | Roth | 72/88 |
| 4,646,549 | 3/1987 | Saito | 72/469 |
| 5,076,086 | 12/1991 | Murayama | 72/88 |

FOREIGN PATENT DOCUMENTS

| | | | |
|---|---|---|---|
| 224838 | 9/1990 | Japan | 72/88 |

*Primary Examiner*—Daniel C. Crane
*Attorney, Agent, or Firm*—Brooks & Kushman P.C.

[57] ABSTRACT

A machine (20) for rolling power transmission formations in a workpiece includes a base (20) having a lower end (24) for providing support thereof in an upwardly standing orientation. The base (22) includes a pair of spaced base portions (30) and a rear connecting base portion (32). The spaced base portions (30) project forwardly from the rear connecting base portion (32) to define a vertically extending workspace (34) and are secured to each other and to the rear connecting base portion by tie rod assemblies (38, 40, 42). Headstock and tailstock spindle supports (48,52) cooperate to rotatably mount the workpiece about a rotational axis (A) of the machine. A pair of vertically movable slides (66) respectively mount a pair of forming racks (68) and are respectively mounted by the spaced base portions (30) on opposite sides of the rotational axis (A) about which the workpiece is rotatably supported such that the forming racks oppose each other and roll power transmission formations in the workpiece during vertical movement in opposite directions.

12 Claims, 12 Drawing Sheets

Fig. 11
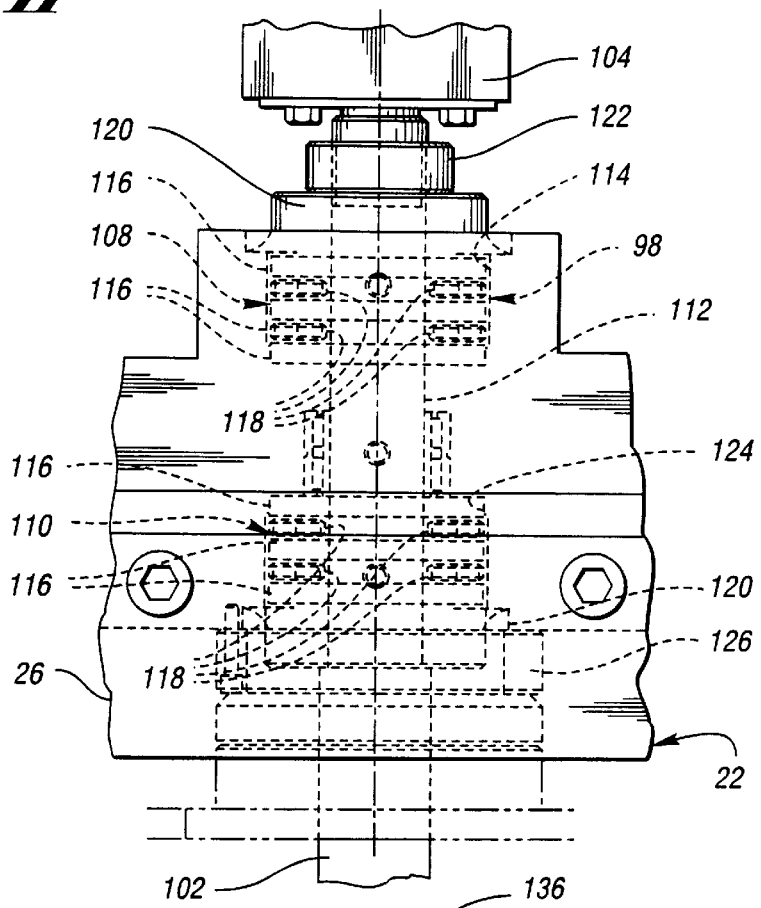
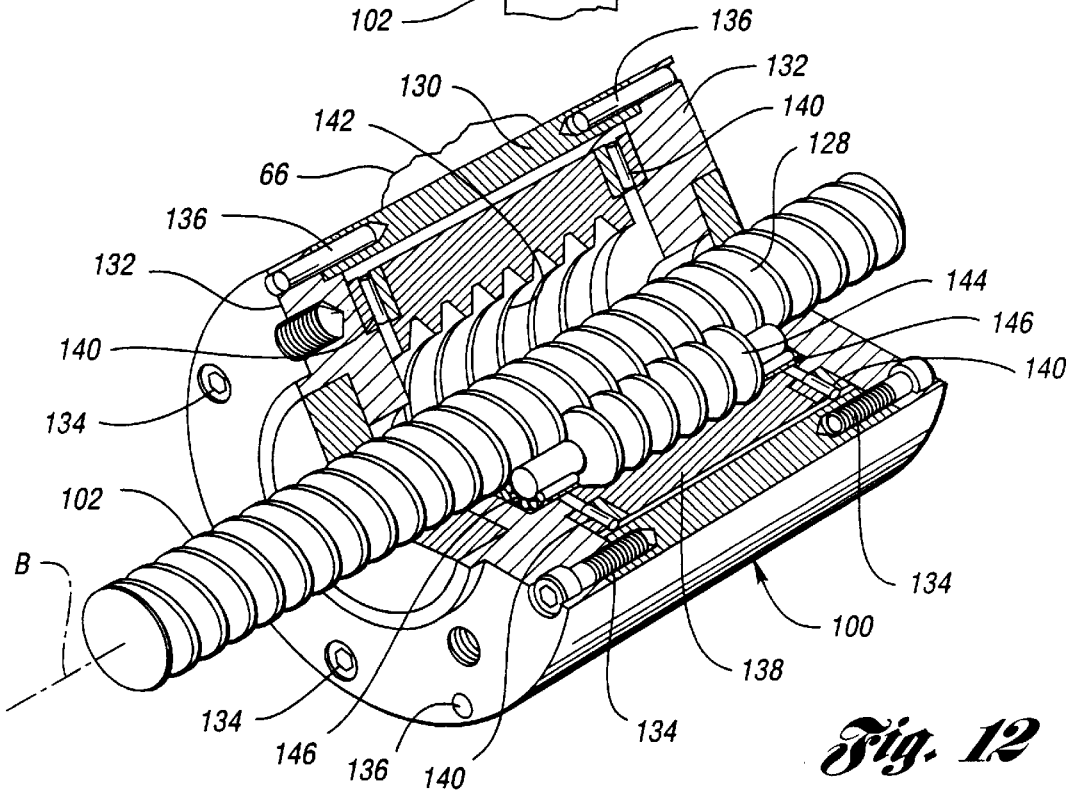
Fig. 12

MACHINE BASE FOR SUPPORTING VERTICAL MOVEMENT OF FORMING RACKS FOR ROLLING POWER TRANSMISSION FORMATIONS

TECHNICAL FIELD

This invention relates to a machine having a base for supporting forming racks for vertical movement that roll forms power transmission formations in a workpiece.

BACKGROUND ART

Power transmission formations such as splines or threads, etc. are rolled in workpieces by machines including a pair of spaced slides that respectively support a pair of forming racks. The forming racks utilized have oppositely facing toothed forming faces located on opposite sides of the workpiece initially in an end-to-end relationship. Hydraulic actuation of the slides moves the forming racks so that toothed forming faces engage the workpiece at diametrically opposite locations to roll the power transmission formations by plastic deformation. Such hydraulic actuation requires that there be continuous operation of a hydraulic pump since it is not practical to cyclically start and fully stop the pump for each workpiece roll forming cycle. Such continuous pump operation thus consumes energy that increases the cost of the resultant product.

Prior art hydraulically actuated machines are disclosed by U.S. Pat. No. 3,793,866 Anderson, et al.; U.S. Pat. No. 4,155,236 Jungesjo; U.S. Pat. No. 4,384,466 Jungesjo; and U.S. Pat. No. 4,519,231 Roth. These prior art machines have the rack slides thereof movable horizontally above and below the workpiece such that the rack movement is in a horizontal direction.

DISCLOSURE OF INVENTION

An object of the present invention is to provide an improved machine for rolling power transmission formations in a workpiece.

In carrying out the above object, a machine constructed in accordance with the invention includes a base having a lower end for providing support thereof in an upwardly standing orientation. The base includes a pair of spaced base portions and a rear connecting base portion located between the spaced base portions. The spaced base portions project forwardly from the rear connecting base portion to define a vertically extending workspace and have distal front ends remote from the rear connecting base portion. Tie rod assemblies of the machine extend horizontally between the spaced base portions to provide securement thereof to the rear connecting base portion and to each other. A headstock spindle support is mounted by the rear connecting base portion, and a tailstock spindle support is mounted by the front ends of the spaced base portions and is cooperable with the headstock spindle support to rotatably mount the workpiece within the workspace for rotation about a rotational axis of the machine. A pair of vertically movable slides of the machine respectively mount a pair of forming racks and are respectively mounted by the spaced base portions on opposite sides of the rotational axis about which the workpiece is rotatably supported such that the forming racks oppose each other and roll power transmission formations in the workpiece during vertical movement in opposite directions. A counterbalance assembly of the machine has a pair of counterbalance racks respectively mounted by the pair of slides and also has a counterbalance gear rotatably mounted by the headstock spindle support and meshed with the pair of counterbalance racks to provide counterbalancing of the pair of slides.

In the preferred construction of the machine, the base includes an upper end having a pair of electric servomotors mounted thereon and also includes a pair of rotary connectors respectively extending between the pair of electric servomotors and the pair of slides to move the slides vertically to perform the rolling of the power transmission formations. Each rotary connector includes a rotary coupling to the base, a rotary coupling to the associated slide, and an elongated rotary connection member that extends vertically and is rotatively driven by the associated electric servomotor. Each rotary connection member is axially fixed to the rotary coupling to the base and threadedly connected to the rotary coupling to the slide to provide vertical movement of the slide upon rotation thereof under the impetus of the associated electric servomotor.

In the preferred construction of the machine, one of the rotary connectors has the rotary coupling thereof to the base located at the upper end of the base adjacent the associated electric servomotor and the elongated rotary connection member thereof extends therefrom to the rotary coupling thereof to the associated slide to pull the slide upwardly past the rotational axis during the rolling of the power transmission formations. The other rotary connector has the rotary coupling thereof to the base located adjacent the rotational axis and the elongated rotary connection member thereof extends therefrom to the associated slide and to the associated electric servomotor to pull the slide downwardly past the rotational axis during the rolling of the power transmission formations.

Each rotary connector preferably has the rotary coupling thereof to the base constructed to include thrust bearings that prevent axial movement of the associated rotary connection member in opposite directions to permit the rolling to be performed upon movement of the forming racks in opposite directions.

The preferred construction of the machine also includes antifriction linear bearings that respectively mount the pair of slides on the pair of spaced base portions within the workspace for the vertical movement that rolls the power transmission formations The machine also preferably includes tie rod assemblies including two rear tie rod assemblies and one front tie rod assembly. The two rear tie rod assemblies extend between the spaced base portions adjacent the rear connecting base portion at lower and upper locations below and above the headstock spindle support, and the front tie rod assembly extends between the spaced base portions adjacent the front ends thereof at a location below the tailstock spindle support.

The machine also preferably includes a lower fluid reservoir and antivibration mounts that support the lower end of the base on the lower fluid reservoir.

The objects, features, and advantages of the present invention are readily apparent from the following detailed description of the best mode for carrying out the invention when taken in connection with the accompanying drawings.

BRIEF DESCRIPTION OF DRAWINGS

FIG. 11 is a view that illustrates a rotary coupling that axially fixes a rotary connection member to the machine base.

FIG. 12 is a partially broken away perspective view illustrating a rotary coupling that threadedly connects an associated forming rack slide with the associated rotary connection member.

BEST MODE FOR CARRYING OUT THE INVENTION

Figure 1:
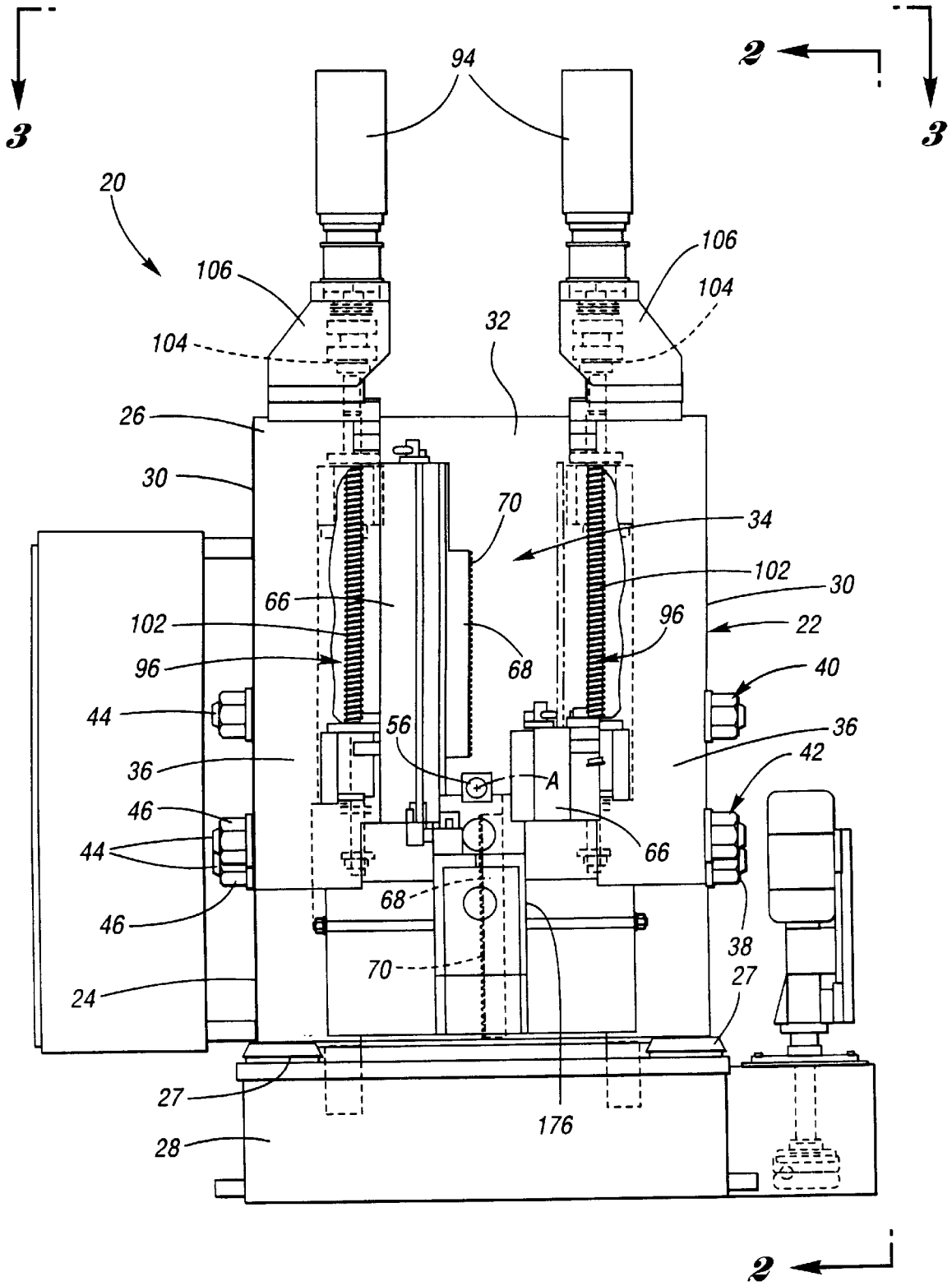
FIG. 1 is front elevational view of a machine for rolling power transmission formations in a workpiece in accordance with the present invention.

With reference to FIG. 1, a machine generally indicated by 20 is constructed in accordance with the present invention to provide rolling of power transmission formations in a workpiece by plastic deformation in a manner that is hereinafter more fully described. The power transmission formations that are rolled into the workpiece may be splines, threads, etc., as well as any other formation utilized in the transmission of power from one member to another such as in a vehicle drivetrain.

Machine 20, as shown by continuing reference to FIG. 1, includes a base 22 having a lower end 24 for providing support thereof in an upwardly extending orientation. Base 22 also has an upper end 26 to which the base extends from its lower end 24 as is hereinafter more fully described. Antivibration mounts 27 mount the lower base end 24 on a lower fluid reservoir 28 for containing lubrication fluid that is pumped to the workpiece to provide lubrication and cooling thereof during the roll forming operation of the machine.

Figure 3:
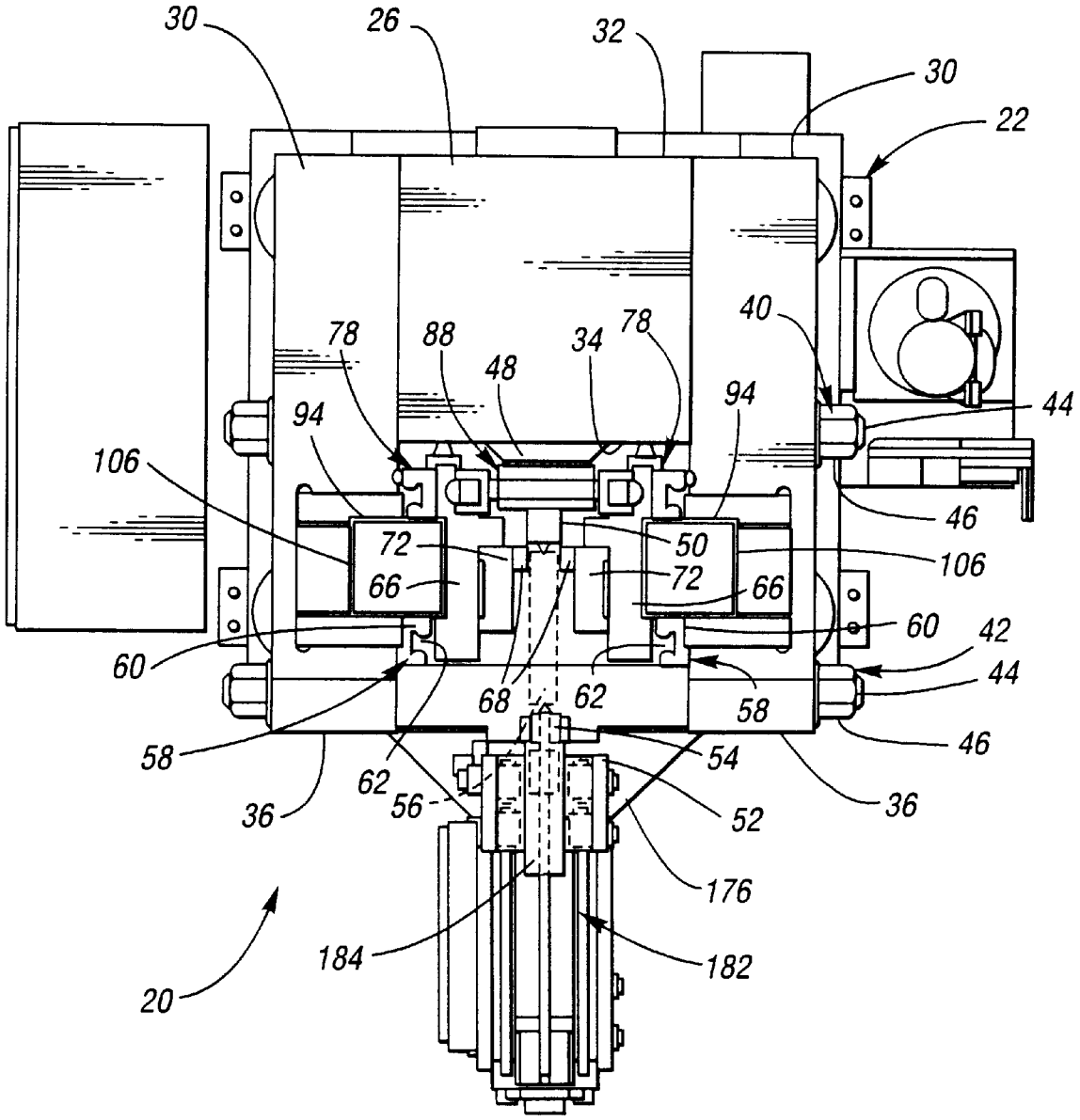
FIG. 3 is a top plan view of the machine taken along the direction of line 3—3 in FIG. 1.

With continuing reference to FIG. 1 and additional reference to FIG. 3, the base 22 includes a pair of spaced base portions 30 and also includes a rear connecting base portion 32 that is located between the spaced base portions. As best shown in FIG. 3, the spaced base portions 30 project forwardly from the connecting base portion 32 to define a vertically extending workspace 34 and have distal front ends 36 remote from the rear connecting base portion.

Figure 2:
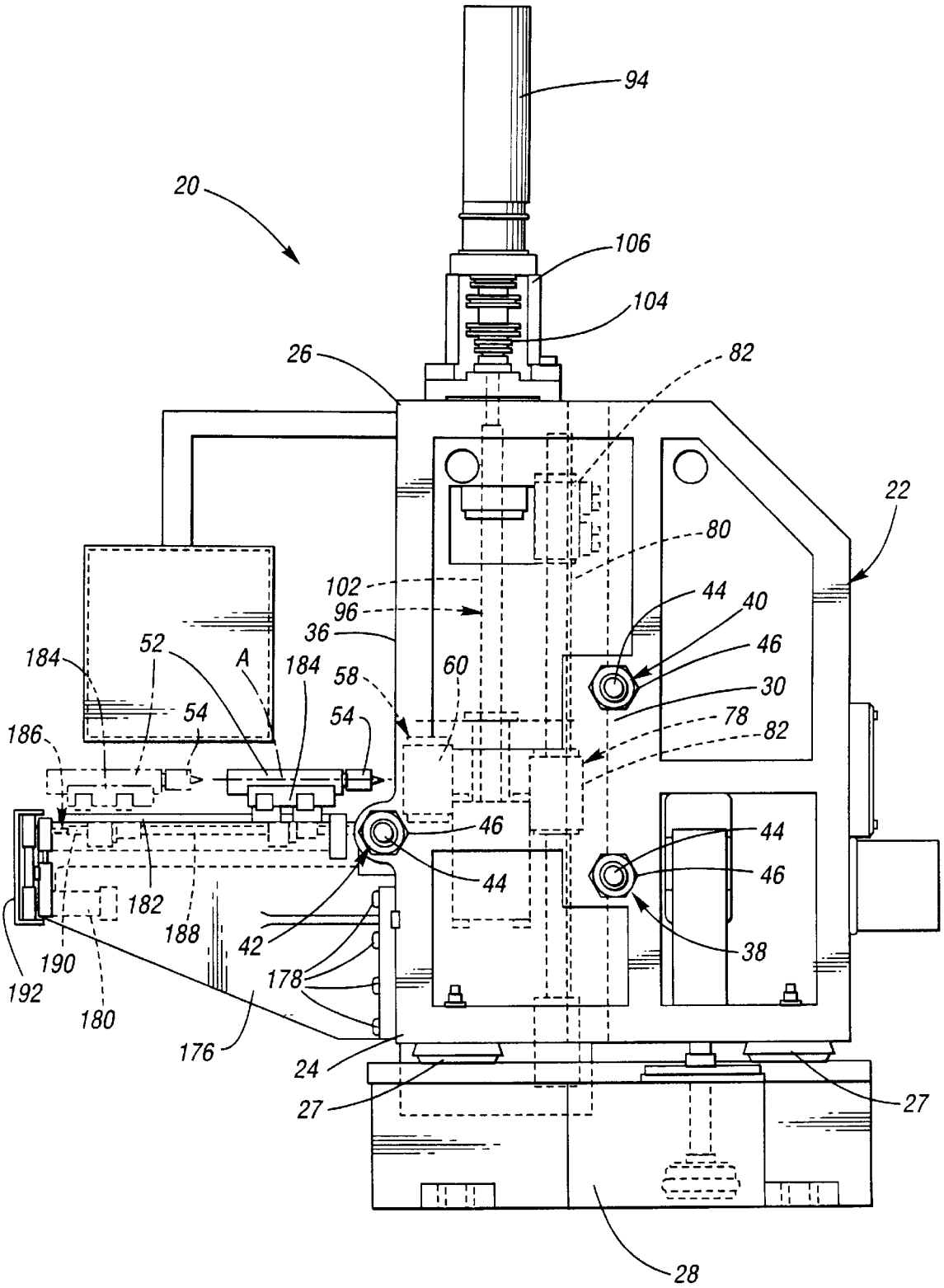
FIG. 2 is a side elevational view of the machine taken along the direction of line 2—2 in FIG. 1.

With combined reference to FIGS. 1, 2 and 3, tie rod assemblies 38, 40 and 42 extend horizontally between the spaced base portions 30 to provide securement thereof to the rear connecting base portion 32 and to each other. Each tie rod assembly includes a tie rod 44 having threaded ends and also includes a pair of nuts 46 threaded onto the ends of the associated tie rod. More specifically, as illustrated in FIG. 2, there are two rear tie rod assemblies 38 and 40 extending between the spaced base portions adjacent the rear connecting base portion 32 at lower and upper locations below and above a workpiece rotational axis A about which the workpiece rotates during the forming operation as is hereinafter more fully described. Furthermore, the tie rod assemblies also include a front tie rod assembly 42 extending between the spaced base portions 30 adjacent the front ends 36 thereof at a location below the workpiece axis A which facilitates the accessibility of the workspace 34 with respect to the workpiece. While the base 22 includes bolt connections 47 (FIG. 5) that connect the spaced base portions 30 and the rear connecting base portion 32, the tie rod assemblies 38, 40 and 42 counteract most of the force that tends to separate the spaced base portions 32 during the roll forming process.

Figure 4:
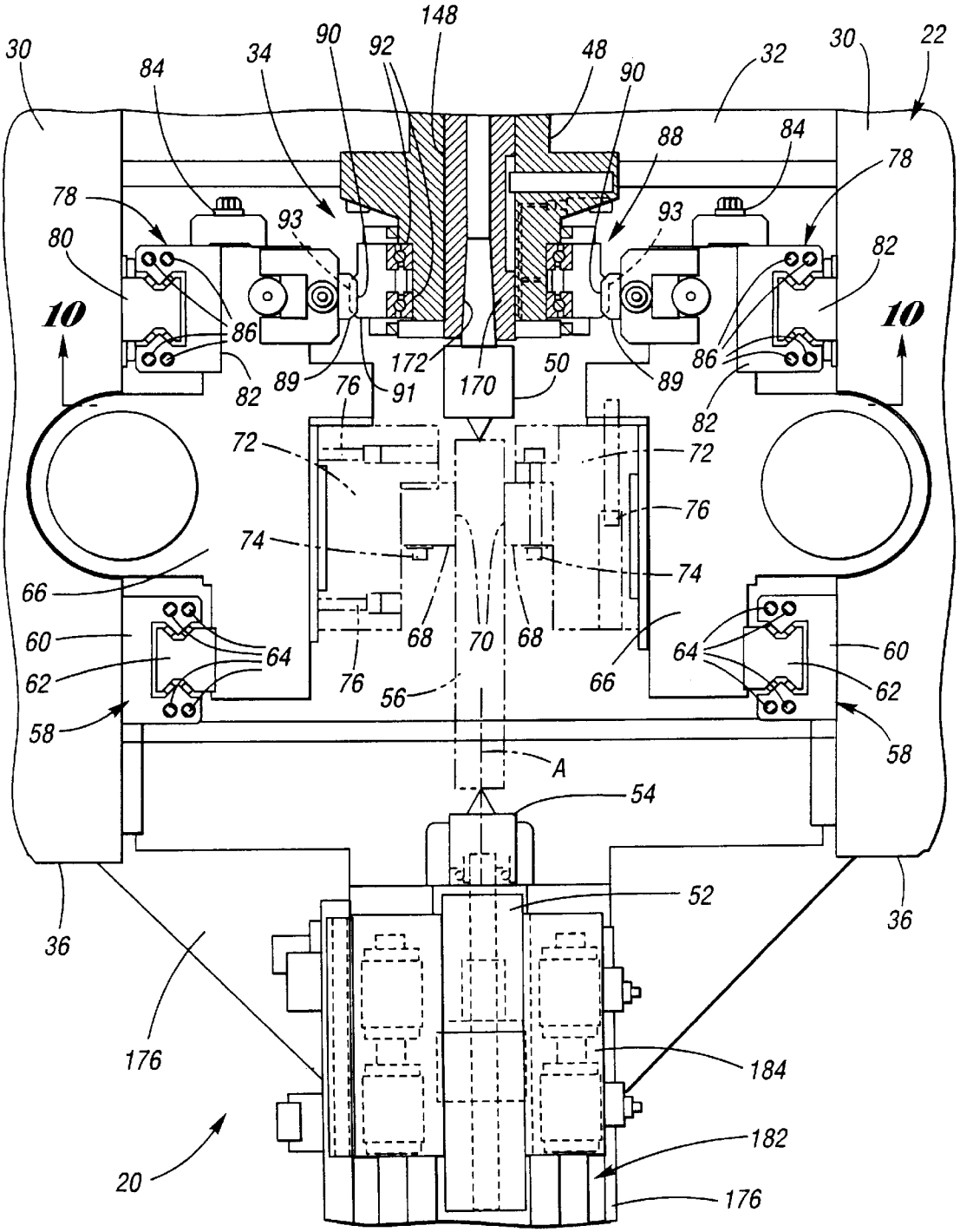
FIG. 4 is a partial top plan view taken in the same direction as FIG. 3 but on an enlarged scale to illustrate the manner in which headstock and tailstock spindles support a phantom line indicated workpiece for rolling of power transmission formations.

As illustrated in FIGS. 2–4, the machine 20 includes a headstock spindle support 48 for mounting a headstock spindle 50 on the rear connecting base portion 32. Furthermore, a tailstock spindle support 52 is mounted by the front ends 36 of the spaced base portions 30 and provides support of a tailstock spindle 54 that cooperates with the headstock spindle 50 to rotatably mount the workpiece 56 about the rotational workpiece axis A about which the forming takes place.

Figure 5:
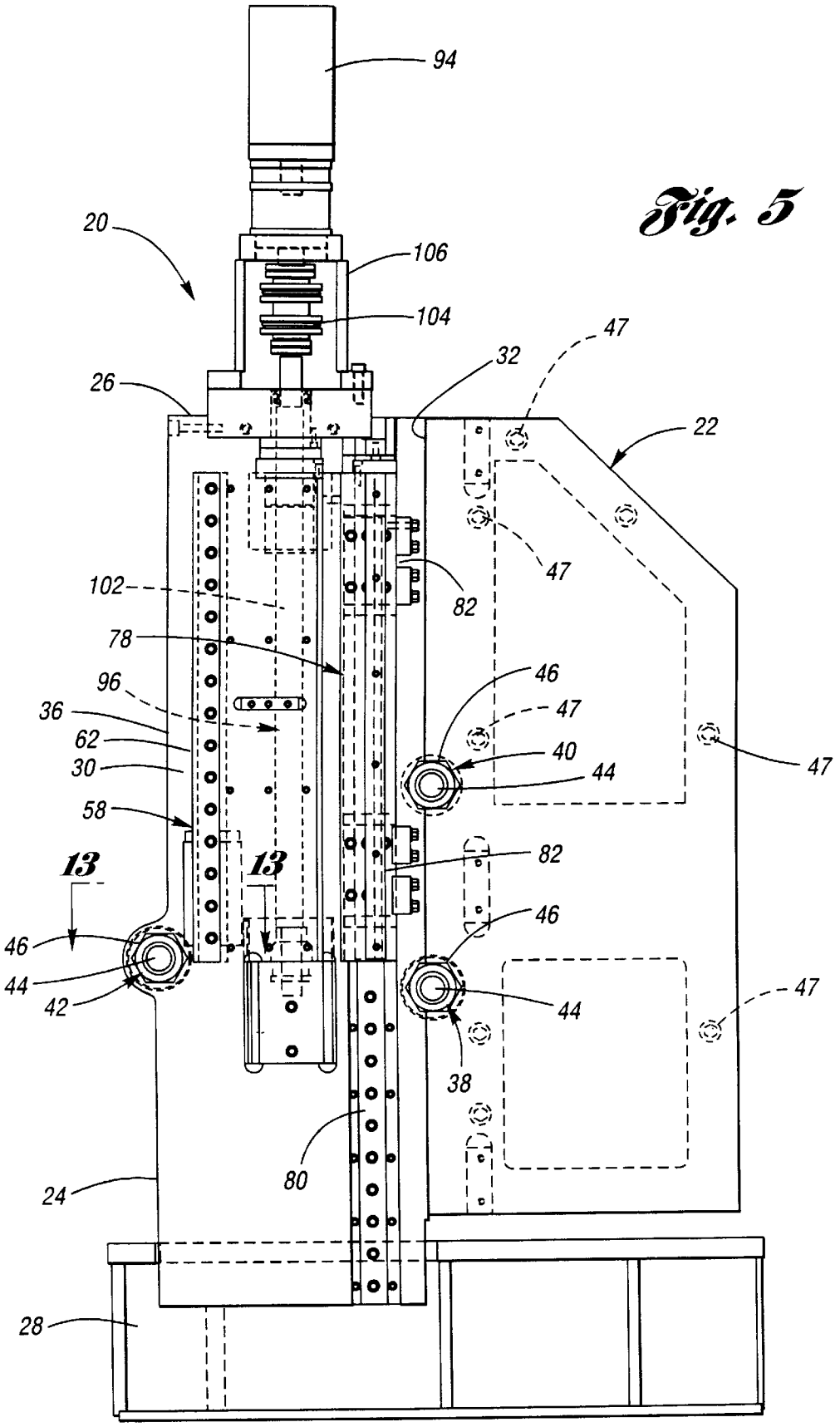
FIG. 5 is a partial side elevation view similar to FIG. 2 but illustrating antifriction linear bearings that provide support of slides on which forming racks are mounted to perform the rolling of the power transmission formations.
Figure 9:
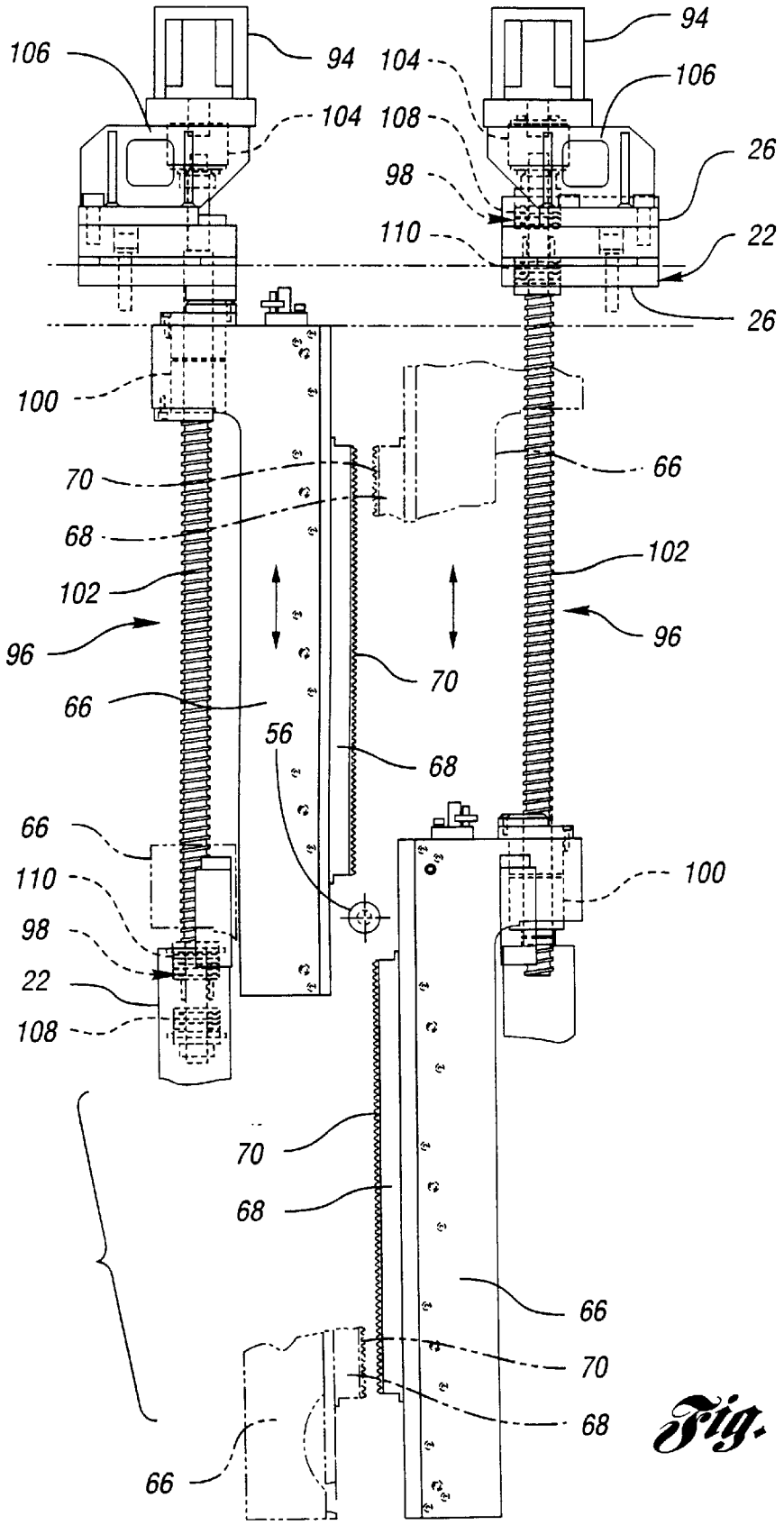
FIG. 9 is a front elevational view similar to FIG. 1 but with portions of the machine not shown to better illustrate forming rack slides, electric servomotors and rotary connectors that drive the rack slides.
Figure 13:
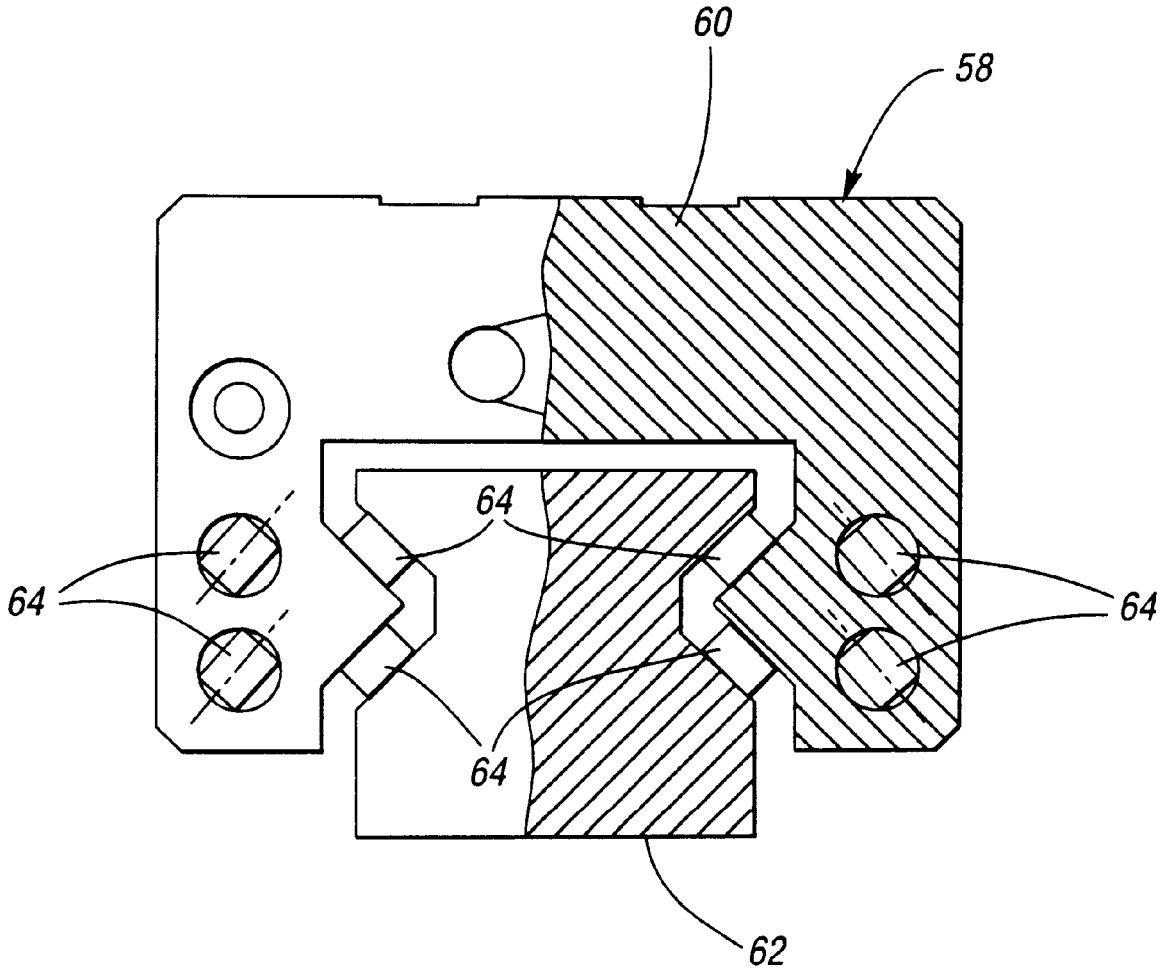
FIG. 13 is a partial sectional view taken along the direction of line 13—13 in FIG. 5 to illustrate the construction of antifriction linear bearings of the machine.

With combined reference to FIGS. 4 and 5, the machine includes a pair of antifriction linear bearings 58 respectively associated with the pair of spaced base portions. Each of these bearings 58 includes a stationary carriage 60 and an elongated movable guideway 62. The stationary carriages 60 are respectively mounted by the pair of spaced base portions 30 with the rotational axis A of the machine therebetween SO as to thus be on opposite sides of the workpiece 56 as illustrated in FIG. 4. Each stationary carriage 60 as shown in FIG. 13 includes rolling elements 64 that support the associated movable guideway 62 for movement along the length thereof on the adjacent side of the supported workpiece 56 as shown in FIG. 4. A pair of movable slides 66 of the machine respectively support a pair of forming racks 68 that are also shown in FIG. 9 as being in an end-to-end relationship at the commencement of each forming cycle. The forming racks 68 have toothed forming faces 70 configured to form power transmission formations in the workpiece. A pair of fixtures 72 shown in FIG. 4 have the pair of forming racks 68 respectively secured thereto by suitable bolts 74 and are themselves respectively secured by bolts 76 to the pair of slides 66 that are mounted for vertical movement by the pair of movable guideways 62 of the pair of antifriction linear bearings 58 as previously described.

Vertically actuated movement of the pair of slides 66 from the end-to-end relationship shown by solid line representation in FIG. 9 moves the forming racks 68 thereon vertically into engagement with the workpiece 56 to provide roll forming of power transmission formations in the workpiece, such as by providing splines or threads, etc. More specifically, the left slide 66 and the forming rack 68 thereon is moved downwardly while the right slide 66 and forming rack 68 thereon is moved upwardly such that the toothed forming faces 70 of the racks engage the workpiece at diametrically opposite locations to provide the forming of the power transmission formations by plastic deformation. The forming is normally in a progressive manner such that the workpiece will execute a number of rotations before the forming is completed. While carriages are normally movable in an antifriction linear bearing, the stationary positioning of the carriages 60 as previously described with the workpiece axis therebetween ensures that the slides are continually supported at the workpiece where the forming tends to urge the slides away from each other. Precise roll forming of the power transmission formations is thus possible.

As shown by reference to both FIGS. 4 and 5, the pair of antifriction linear bearings 58 are mounted on the pair of spaced base portions 30 adjacent their distal ends 36 remote from the rear connecting base portion 32 and are thus located adjacent the front tie rod assembly 42 which is located just slightly below the rotational axis A of the machine. A second pair of antifriction linear bearings 78 of the machine are respectively associated with the pair of spaced base portions 30 and are located adjacent the rear connecting base portion 32. This second pair of antifriction linear bearings 78 cooperates with the first pair of antifriction linear bearings 58 to respectively supporting the pair of movable slides 66 that support the forming racks 68 as previously described. Each of the second pair of antifriction linear bearings 78 includes a stationary guideway 80 and a pair of movable carriages 82 (FIG. 5) located at the upper and lower ends of the associated slide. More specifically, each stationary guideway 80 extends vertically and is secured in a suitable manner to the associated base portion 30 adjacent the rear connecting base portion 32. Furthermore, the pair of movable carriages 82 of each antifriction linear bearing 78 are respectively secured to the pair of slides 66 at vertically spaced locations by retainers 84 shown in FIG. 4. Each movable carriage 82 includes rolling elements 86 that provide support thereof for vertical movement of the slides in the same manner previously described in connection with the pair of antifriction linear bearings 58. Such support of the slides thus supports the forming racks 68 as previously described for movement from their end-to-end position shown by solid line representation in FIG. 9 into an overlapping relationship and ultimately into an end-to-end relationship of their opposite ends as shown by partial phantom line representation.

Figure 10:
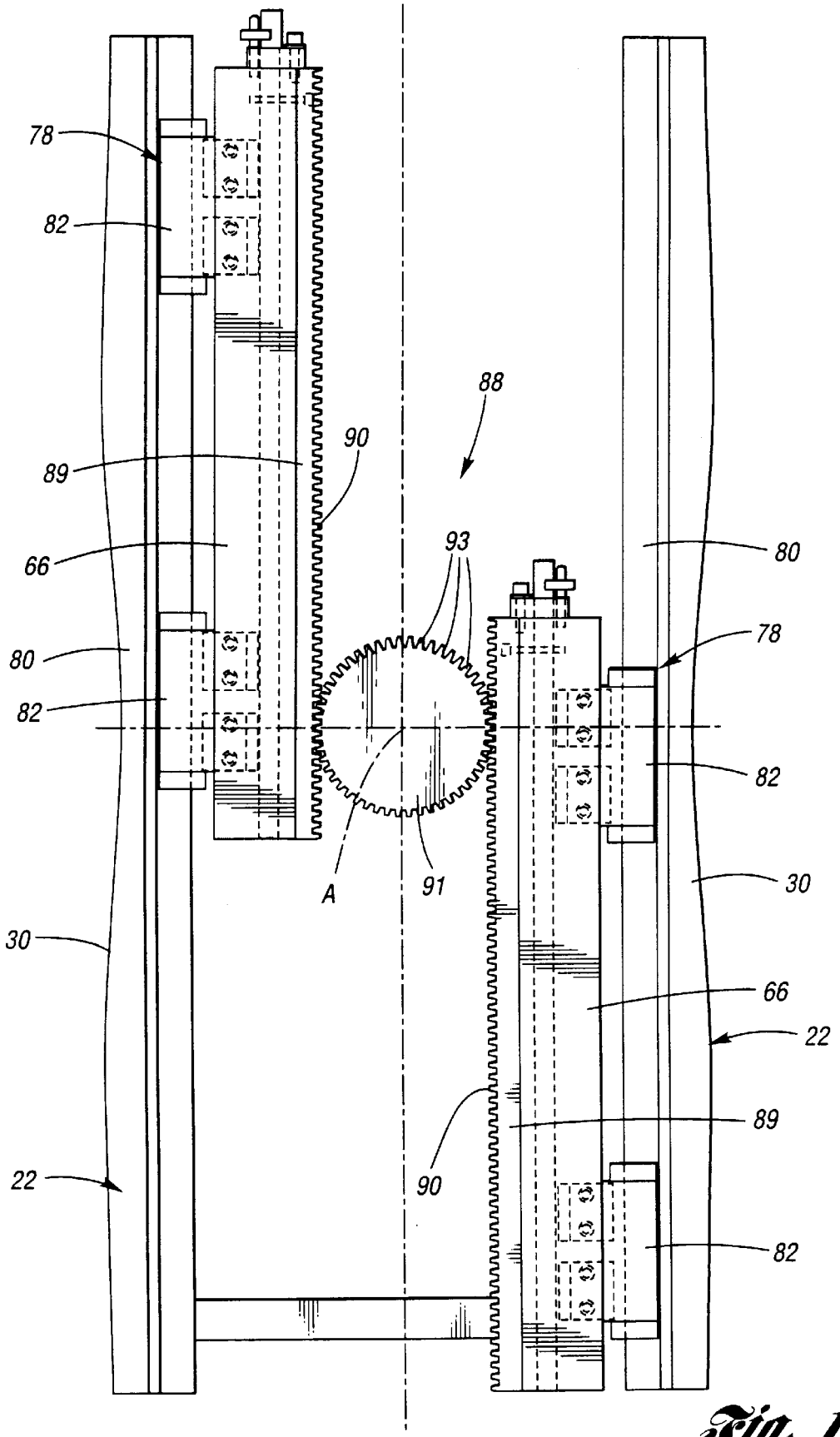
FIG. 10 is an elevation view taken along the direction of line 10—10 in FIG. 4 to illustrate a counterbalance assembly that counterbalances vertical movement of the pair of slides on which the forming racks are mounted.

With reference to FIGS. 4 and 10, the machine 20 also includes a counterbalance assembly 88 that is located adjacent the rear connecting base portion 32 and hence adjacent the second pair of antifriction linear bearings 78 previously described and shown in FIG. 4. This counterbalance assembly 88 includes a pair of counterbalance racks 89 that each have a toothed face 90. The pair of counterbalance racks 89 are respectively mounted on the pair of slides 66 in a vertically extending orientation so as to be movable therewith during the vertical slide movement that provides the forming of the workpiece. Counterbalance assembly 88 also includes a counterbalance gear 91 rotatably mounted by rotary antifriction bearings 92 (FIG. 4) on the headstock spindle support 48 and having teeth 93 meshed as shown in FIG. 10 with the toothed faces 90 of the pair of counterbalance racks 89 at diametrically opposite locations. Such meshing engagement between the pair of counterbalance racks 89 and the counterbalance gear 91 provides counterbalancing of the pair of slides 66 and the forming racks thereon during the forming of the workpiece as previously described.

With reference to FIGS. 1 and 9, the machine 20 also includes a pair of electric servomotors 94 for respectively moving the pair of slides 66 and the forming racks 68 thereon to roll the power transmission formations in the workpiece as previously described. A pair of slide rotary connectors 96, best illustrated in FIG. 9, respectively extend between the pair of servomotors 94 and the pair of slides 66 on which the forming racks 68 are mounted. Each rotary connector 96 includes a rotary coupling 98 to the machine base 22 and also includes a rotary coupling 100 to the associated slide 66. An elongated rotary connection member 102 of each rotary connector 96 extends vertically and is rotatively driven by the associated electric servomotor 94 through a gear reducer 104. Each rotary connection member 102 is rotatively driven by the associated electric servomotor 94 through the associated gear reducer 104 and is axially fixed by the associated rotary coupling 98 to the base as well as being threadedly connected to the associated rotary coupling 100 to the associated slide 66 such that the driving rotation thereof provides movement of the slide under the impetus of the electric servomotor.

As illustrated best in FIG. 1, the machine base 22 includes mounts 106 that respectively support the pair of electric servomotors 94 in a side-by-side relationship. As shown, the electric servomotors 94 extend upwardly; however, it should be appreciated that it is also possible for mounts 106 to support the electric servomotors 94 extending horizontally when there is a height limitation. One of the rotary connectors 96, specifically the right one as shown in FIG. 9, has the rotary coupling 98 thereof to the base 22 located adjacent the associated electric servomotor 94 adjacent the upper base end 26. The associated elongated rotary connection member 102 extends from this upper coupling 98 downwardly to the rotary coupling 100 thereof to the associated slide 66 to pull the slide past the rotational axis A during the rolling of the power transmission formations in the workpiece as previously described. The other rotary connector 96, specifically the left one as shown in FIG. 9, has the rotary coupling 98 thereof to the base 22 located adjacent the rotational axis A and the elongated rotary connection member 102 thereof extends upwardly therefrom to the rotary coupling 100 thereof to the associated slide 66 and to the associated electric servomotor 94 to pull the slide past the rotational axis A during the rolling of the power transmission formations.

Each of the rotary couplings 98 to the base 22 has the construction illustrated in FIG. 11 and specifically includes a pair of axial thrust bearings 108 and 110 connected to the rotary connection member 102. More specifically, the rotary connection member 102 has a reduced diameter end 112 that receives both of the thrust bearings 108 and 110. The base 22 has an upwardly opening recess 114 that receives the thrust bearing 108 adjacent the distal end of the reduced diameter portion 112 of the rotary connection member 102 where there it is driven from the gear unit 104 under the impetus of the associated electric servomotor. Thrust bearing 108 has alternating annular thrust rings 116 and rolling element embodied by rollers 118. An annular clamp 120 and a retaining nut 122 on the end of the reduced diameter portion 112 of the rotary connection member 102 provides securement thereof to the thrust bearing 108 so as to prevent downward movement of the rotary connection member as it is rotated to pull the associated slide upwardly. Similarly, the thrust bearing 110 is received within a downwardly opening recess 124 in the machine base 22 and also includes alternating thrust rings 116 and rolling elements embodied by rollers 118 with an annular clamp 120 secured by a bolted clamp ring 126. This thrust bearing 110 thus prevents upward movement of the connection member 102 and thereby permits the movement of the slide and the forming rack thereon to provide rolling of the power transmission formations during both directions of movements.

It will be appreciated that the other lower coupling 98 to base 22 adjacent the rotational axis A as shown in FIG. 9 is inverted from the above-described upper coupling 98 as far as the thrust bearings 108 and 110 thereof that respectively axially fix these couplings to the base during both directions of movements. Furthermore, it will be appreciated that the locations of the thrust bearings 98 as previously described in connection with FIG. 9 provides loading of the rotary connection members 102 both in tension during one direction of the forming and both in compression during the other direction of forming so that their movements are actuated in the same manner to ensure uniformity of the rolled power transmission formations in the workpiece.

With reference to FIG. 12, the rotary coupling 100 is axially secured in a suitable manner to the slide 66 and has the rotary connection member 102 extending therethrough with a construction including a helical thread 128. The coupling 100 has a housing including an elongated annular housing member 30 as well as opposite end members 132 that are secured to the housing member 130 by bolts 134 in association with alignment pins 136. A planet carrier 138 is rotatably supported about the axis B of the rotary connection member 102 by bearing elements embodied by rollers 140 and has a central threaded interior including threads 142. Planet screws 144 are rotatably supported by antifriction bearings 146 and are in threaded engagement with both the thread 128 of the rotary connection member 102 and the thread 142 of the planet carrier 138. Actually, there are a number of the planet screws 144, normally three arranged at 120° with respect to each other, even though only one is illustrated. Rotation of the rotary connection member 102 under the impetus of the associated electric servomotor through the threaded construction illustrated moves the rotary coupling 100 and the slide 66 secured thereto along the axis B to thereby move the forming racks that roll the power transmission formations in the workpiece as previously described.

Figure 6:
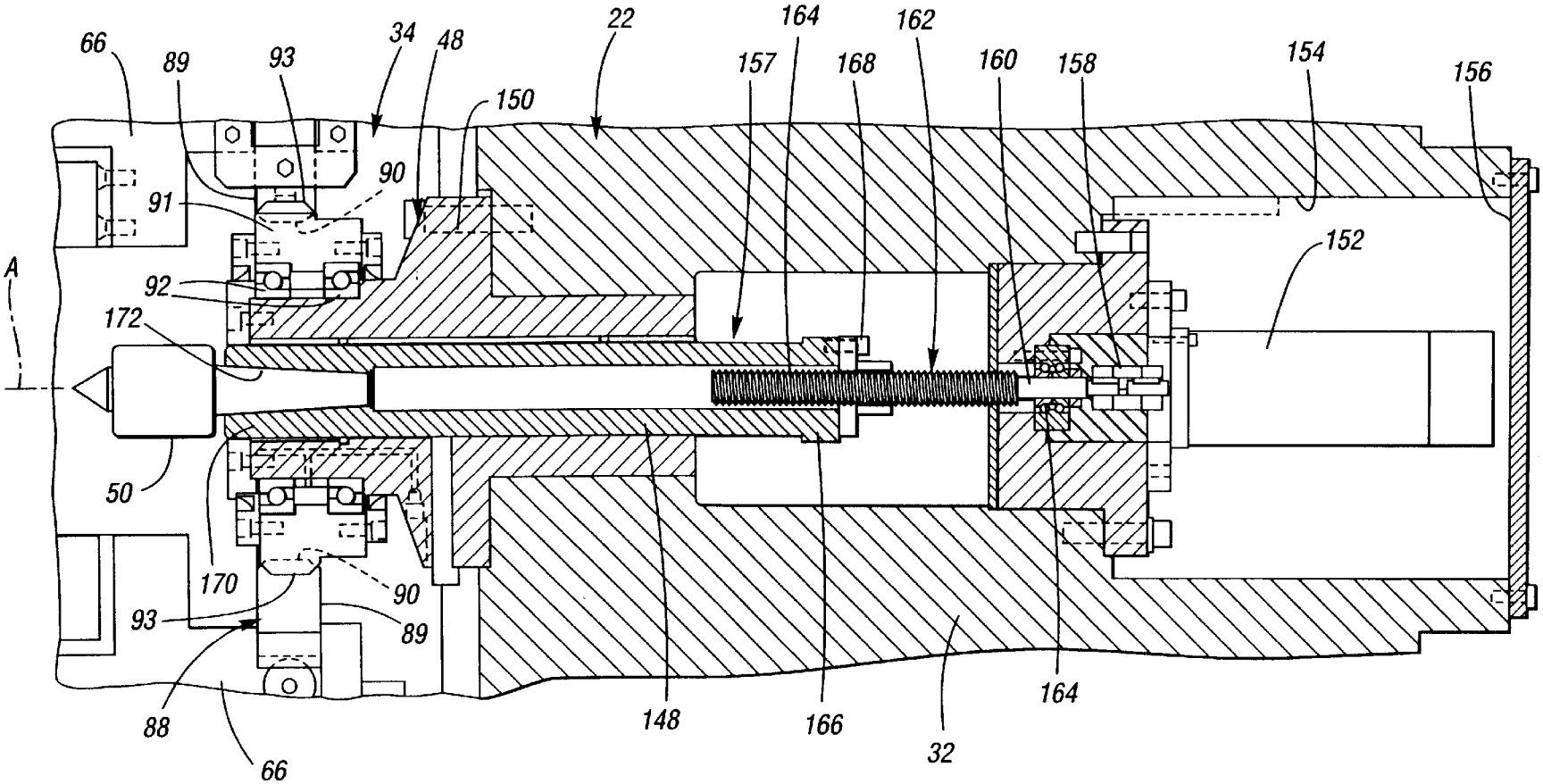
FIG. 6 is a partial top plan view taken in the same direction as FIG. 4 but shown partially in section to illustrate the construction of a headstock spindle support that mounts the headstock spindle.

With reference to FIGS. 4 and 6, the headstock spindle support 48 includes a quill 148 that is supported by a mount 150 on the rear connecting base portion 32 within the workspace 34 along the rotational axis A of the machine and is movable along the rotational axis. A headstock electric servomotor 152 is mounted by the rear connecting base portion 32 within an opening 154 that is closed by a removable access plate 156. A headstock rotary connector 157 (FIG. 6) extends between the headstock electric servomotor 152 and the quill 148 to move the quill along the rotational axis A. More specifically, the headstock electric servomotor 152 rotatively drives a rotary coupling 158 that drives one end 160 of a screw 162. An antifriction bearing 164 supports the end 160 of screw 162 which has another end 164 received within one end 166 of the quill 148. A ball screw assembly 168 on the quill end 166 threadedly receives the screw 162 such that its rotation moves the quill 148 along the rotational axis A within the mount 150. Another end 170 of quill 148 has a tapered opening 172 that receives the headstock spindle 50 to provide mounting thereof along the rotational axis A. Thus, the operation of the headstock electric servomotor 152 which can be controlled from a remote operator location moves the headstock spindle 50 to provide adjustment thereof as necessary in preparation for each cycle and also permits axial movement of the workpiece during each cycle to permit rolling of power transmission formations at different locations during opposite directions of movement of the slides on which the forming racks are mounted as previously described.

As also illustrated in FIGS. 4 and 6, it should be noted that the headstock mount 150 supports the antifriction bearings 92 that rotatively mount the counterbalance gear 94 meshed with the pair of counterbalance racks 90 respectively mounted on the pair of slides 66, as previously described in connection with the description of the counterbalance assembly 88.

With combined reference to FIGS. 2, 4, 7 and 8, the tailstock spindle support 52 for mounting the tailstock spindle 54 includes a mount 176 secured on the front ends 36 of the spaced base portions 30 by attachment bolts 178 (FIG. 2). The tailstock spindle support 52 is supported by the mount 176 for movement along the rotational axis A as is hereinafter more fully described and is cooperable with the headstock spindle support to rotatively mount the workpiece 56 in cooperation with the headstock and tailstock spindles 50 and 54 as shown in FIG. 4. A tailstock electric servomotor 180 shown in FIG. 2 moves the tailstock spindle support 52 along the rotational axis A to permit loading and unloading of the workpiece as well as permitting rolling of power transmission formations at different locations along the length of the workpiece as previously described when the forming is performed in two directions of movement of the forming racks.

Figure 7:
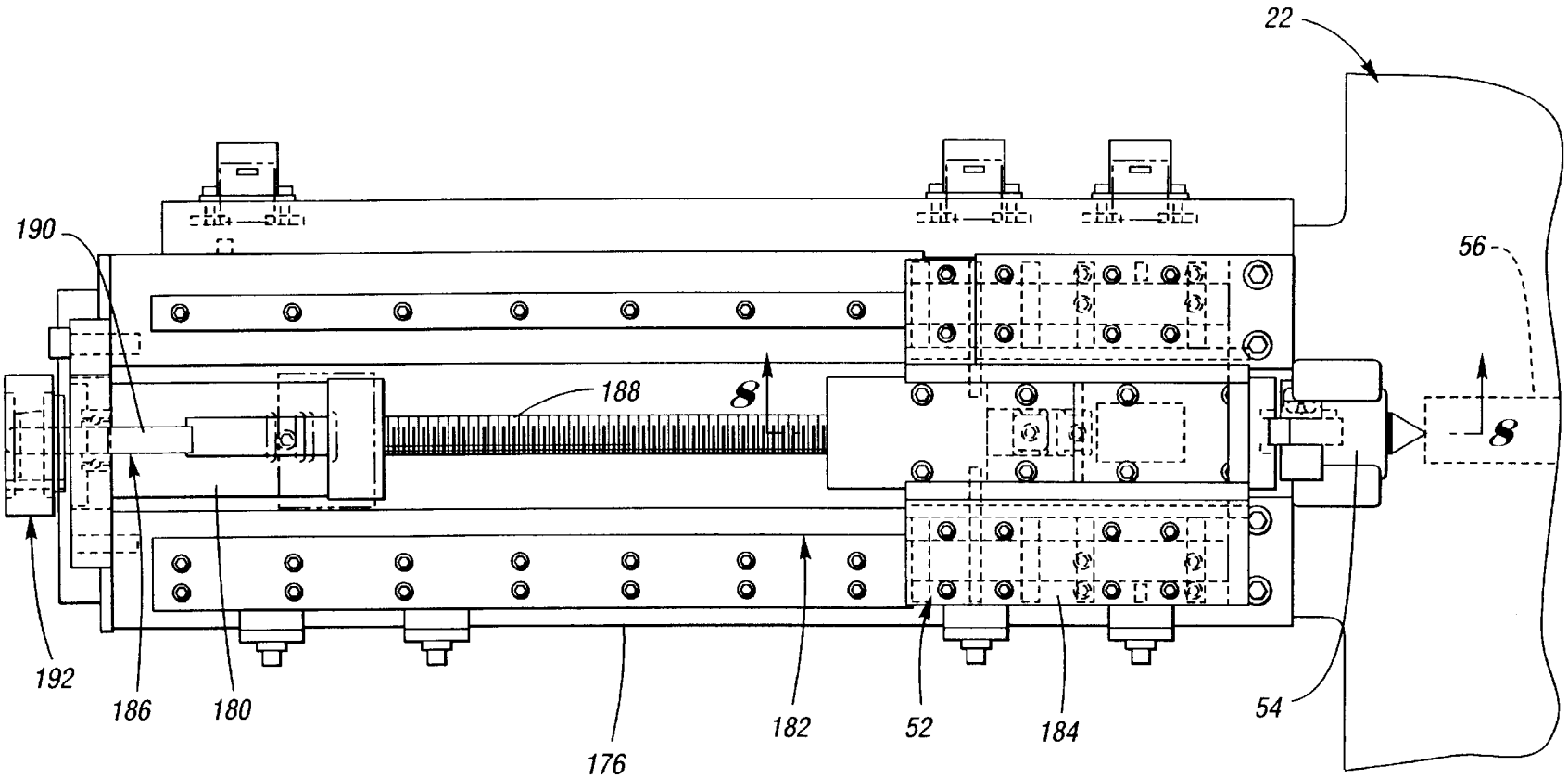
FIG. 7 is a plan view also taken in the same direction as FIG. 4 to illustrate a tailstock spindle support that mounts the tailstock spindle for supporting the workpiece.
Figure 8:
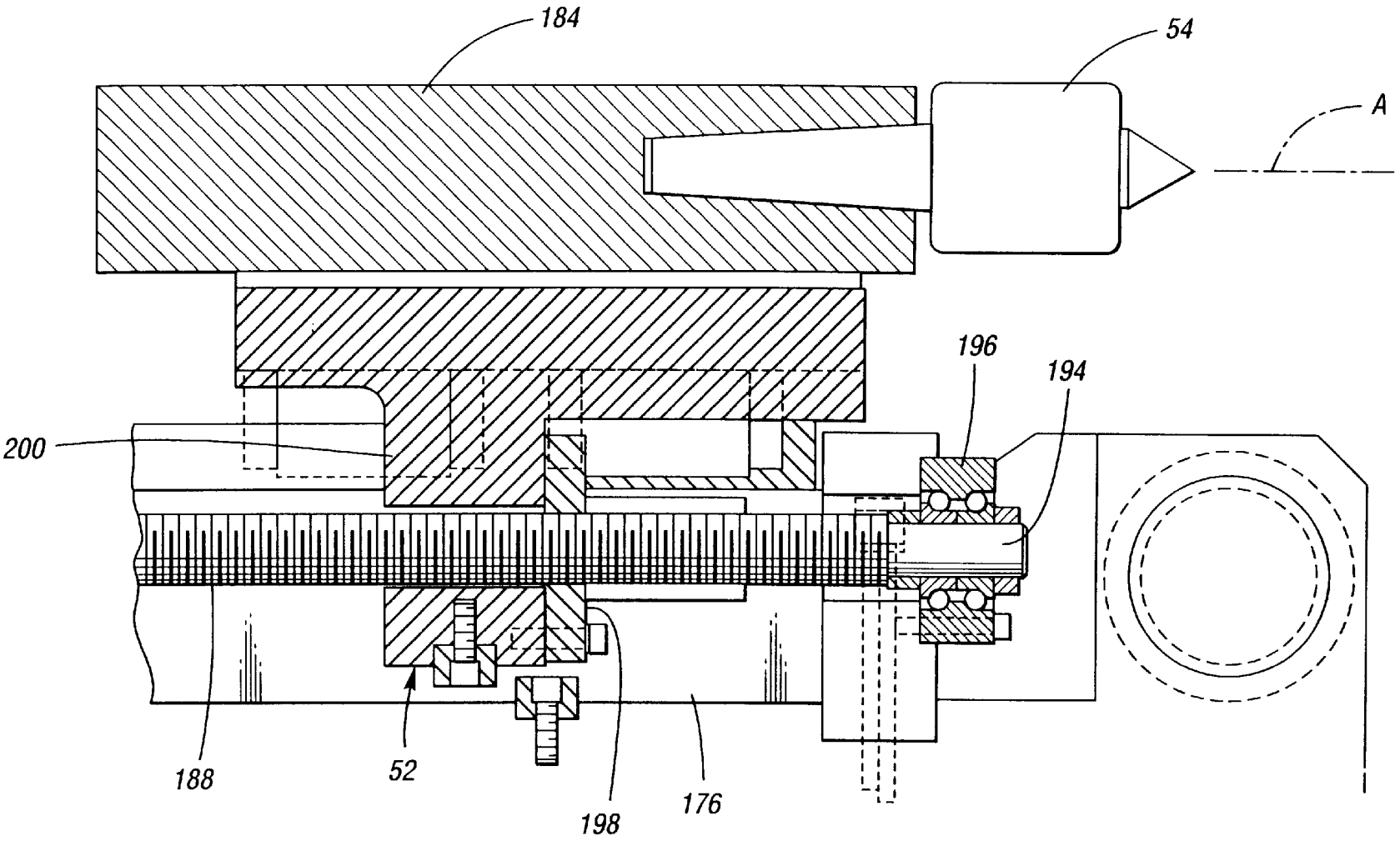
FIG. 8 is a sectional view taken along the direction of line 8—8 in FIG. 7 to further illustrate the construction of the tailstock spindle support.

As illustrated in FIG. 7, the tailstock spindle support mount 176 on the front ends 36 of the spaced base portions 30 includes a slideway collectively indicated by 182. A tailstock center block 184 supports the tailstock spindle 54 as shown in FIG. 8 and is movable on the slideway 182 along the rotational axis A about which the rolling is performed. A tailstock rotary connector collectively indicated by 186 in FIGS. 2 and 7 extends between the tailstock electric servomotor 180 and the tailstock center block 184 to move the tailstock center block along the rotational axis A. More specifically, the tailstock rotary connector 186 includes a rotary connection member 188 having one end 190 that is rotatively driven by the tailstock electric servomotor 180 through a rotary coupling 192. Another end 194 of the rotary connection member 188 is rotatively supported as shown in FIG. 8 by an antifriction bearing 196 on the mount 176. Between its ends, the rotary connection member 188 is threaded and is threadingly received by a ball screw assembly 198 that is mounted on a downward extension 200 of the tailstock center block 184. Rotation of the connection member 188 by the tailstock electric servomotor 180 (FIG. 2) thus moves the tailstock center block 184 along the rotational axis A by its threading engagement with the ball screw assembly 198 shown in FIG. 8.

While the best mode for carrying out the invention has been described in detail, those familiar with the art to which this invention relates will recognize various alternative ways of practicing the invention as defined by the following claims.

What is claimed is:

1. A machine for rolling power transmission formations in a workpiece, comprising:

a base having a lower end for providing support thereof in an upwardly standing orientation, the base including a pair of spaced base portions and a rear connecting base portion located between the spaced base portions, and the spaced base portions projecting forwardly from the rear connecting base portion to define a vertically extending workspace and having distal front ends remote from the rear connecting base portion;

tie rod assemblies that extend horizontally between the spaced base portions to provide securement thereof to the rear connecting base portion and to each other;

a headstock spindle support mounted by the rear connecting base portion;

a tailstock spindle support mounted by the front ends of the spaced base portions and cooperable with the headstock spindle support to rotatably mount the workpiece within the workspace for rotation about a rotational axis of the machine;

a pair of vertically movable slides for respectively mounting a pair of forming racks and being respectively mounted by the spaced base portions on opposite sides of the rotational axis about which the workpiece is rotatably supported such that the forming racks oppose each other and roll power transmission formations in the workpiece during vertical movement in opposite directions; and a counterbalance assembly having a pair of counterbalance racks respectively mounted by the pair of slides and also having a counterbalance gear rotatable mounted by the headstock spindle support and meshed with the pair of counterbalance racks to provide counterbalancing of the pair of slides.

2. A machine as in claim 1 wherein the base includes an upper end having a pair of electric servomotors mounted thereon, and a pair of rotary connectors respectively extending between the pair of servomotors and the pair of slides to move the slides vertically to perform the rolling of the power transmission formations.

3. A machine as in claim 2 wherein each rotary connector includes a rotary coupling to the base, a rotary coupling to the associated slide, and an elongated rotary connection member that extends vertically and is rotatively driven by the associated electric servomotor and axially fixed to the rotary coupling to the base and threadedly connected to the rotary coupling to the slide to provide vertical movement of the slide upon rotation thereof under the impetus of the associated electric servomotor.

4. A machine as in claim 3 wherein one of the rotary connectors has the rotary coupling thereof to the base located at the upper end of the base adjacent the associated electric servomotor and the elongated rotary connection member thereof extending therefrom to the rotary coupling thereof to the associated slide to pull the slide upwardly past the rotational axis during the rolling of the power transmission formations, and the other rotary connector having the rotary coupling thereof to the base located adjacent the rotational axis and the elongated rotary connection member thereof extending therefrom to the associated slide and to the associated electric servomotor to pull the slide downwardly past the rotational axis during the rolling of the power transmission formations.

5. A machine as in claim 4 wherein each rotary connector has the rotary coupling thereof to the base constructed to include thrust bearings that prevent axial movement of the associated rotary connection member in opposite directions to permit the rolling to be performed upon movement of the forming racks in opposite directions.

6. A machine as in claim 1 or 4 further including antifriction linear bearings that respectively mount the pair of slides on the pair of spaced base portions within the workspace for the vertical movement that rolls the power transmission formations.

7. A machine as in claim 1 or 4 wherein the tie rod assemblies include two rear tie rod assemblies and one front tie rod assembly, the two rear tie rod assemblies extending between the spaced base portions adjacent the rear connecting base portion at lower and upper locations below and above the headstock spindle support, and the front tie rod assembly extending between the spaced base portions adjacent the front ends thereof at a location below the tailstock spindle support.

8. A machine as in claim 1 further including a lower fluid reservoir, and antivibration mounts that support the lower end of the base on the lower fluid reservoir.

9. A machine for rolling power transmission formations in a workpiece, comprising:

a base having a lower end for providing support thereof in an upwardly standing orientation and also having an upper end, the base including a pair of spaced base portions and a rear connecting base portion located between the spaced base portions, the spaced base portions projecting forwardly from the rear connecting base portion to define a vertically extending workspace and having front distal ends remote from the rear connecting base portion;

a lower fluid reservoir, and antivibration mounts that support the lower end of the base on the lower fluid reservoir;

tie rod assemblies that extend horizontally between the spaced base portions to provide securement thereof to the rear connecting base portion and to each other;

a headstock spindle support mounted by the rear connecting base portion;

a tailstock spindle support mounted by the front ends of the spaced base portions and cooperable with the headstock spindle support to rotatably mount the workpiece within the workspace for rotation about a rotational axis of the machine;

a pair of vertically movable slides for respectively mounting a pair of forming racks;

antifriction linear bearings that respectively mount the pair of slides for vertical movement on the spaced base portions within the workspace on opposite sides of the rotational axis about which the workpiece is rotatably supported;

a counterbalance assembly having a pair of counterbalance racks respectively mounted by the pair of slides and also having a counterbalance gear rotatably mounted by the headstock spindle support and meshed with the pair of counterbalance racks to provide counterbalancing of the pair of slides; and a pair of electric servomotors mounted on the upper end of the base, and a pair of rotary connectors respectively extending between the pair of electric servomotors and the pair of slides to move the slides vertically to roll power transmission formations in the workpiece.

10. A machine for rolling power transmission formations in a workpiece, comprising:

a base having a lower end for providing support thereof in an upwardly standing orientation and also having an upper end, the base including a pair of spaced base portions and a rear connecting base portion located between the spaced base portions, the spaced base portions projecting forwardly from the rear connecting base portion to define a vertically extending workspace and having front distal ends remote from the rear connecting base portion;

a lower fluid reservoir, and antivibration mounts that support the lower end of the base on the lower fluid reservoir;

tie rod assemblies that extend horizontally between the spaced base portions to provide securement thereof to the rear connecting base portion and to each other;

a headstock spindle support mounted by the rear connecting base portion;

a tailstock spindle support mounted by the front ends of the spaced base portions and cooperable with the headstock spindle support to rotatably mount the workpiece within the workspace for rotation about a rotational axis of the machine;

a pair of vertically movable slides for respectively mounting a pair of forming racks;

antifriction linear bearings that respectively mount the pair of slides for vertical movement on the spaced base portions within the workspace on opposite sides of the rotational axis about which the workpiece is rotatably supported;

a counterbalance assembly having a pair of counterbalance racks respectively mounted by the pair of slides and also having a counterbalance gear rotatably mounted by the headstock spindle support and meshed with the pair of counterbalance racks to provide counterbalancing of the pair of slides; and a pair of electric servomotors mounted on the upper end of the base in a side-by-side relationship, and a pair of rotary connectors respectively extending between the pair of electric servomotors and the pair of slides to move the slides vertically to roll power transmission formations in the workpiece, each rotary connector including a rotary coupling to the base, a rotary coupling to the associated slide, and an elongated rotary connection member that is rotatively driven by the associated electric servomotor and axially fixed to the rotary coupling to the base and threadedly connected to the rotary coupling to the slide to provide movement of the slide upon rotation thereof under the impetus of the associated electric servomotor, one of the rotary connectors having the rotary coupling thereof to the base located adjacent the associated electric servomotor and the elongated rotary connection member thereof extending therefrom to the rotary coupling thereof to the associated slide to pull the slide past the rotational axis such that the forming rack thereon rolls power transmission formations in the workpiece, and the other rotary connector having the rotary coupling thereof to the base located adjacent the rotational axis and the elongated rotary connection member thereof extending therefrom to the rotary coupling thereof to the associated slide and to the associated electric servomotor to pull the slide past the rotational axis such that the forming rack thereon rolls power transmission formations in the workpiece.

11. A machine for rolling power transmission formations in a workpiece, comprising:

a base having a lower end for providing support thereof in an upwardly standing orientation, the base including a pair of spaced base portions and a rear connecting base portion located between the spaced base portions, and the spaced base portions projecting forwardly from the rear connecting base portion to define a vertically extending workspace and having distal front ends remote from the rear connecting base portion;

tie rod assemblies that extend horizontally between the spaced base portions to provide securement thereof to the rear connecting base portion and to each other, the tie rod assemblies including two rear tie rod assemblies and one front tie rod assembly, the two rear tie rod assemblies extending between the spaced base portions adjacent the rear connecting base portion at lower and upper locations below and above the headstock spindle support, and the front tie rod assembly extending between the spaced base portions adjacent the front ends thereof at a location below the tailstock spindle support;

a headstock spindle support mounted by the rear connecting base portion;

a tailstock spindle support mounted by the front ends of the spaced base portions and cooperable with the headstock spindle support to rotatably mount the workpiece within the workspace for rotation about a rotational axis of the machine; and a pair of vertically movable slides for respectively mounting a pair of forming racks and being respectively mounted by the spaced base portions on opposite sides of the rotational axis about which the workpiece is rotatably supported such that the forming racks oppose each other and roll power transmission formations in the workpiece during vertical movement in opposite directions.

12. A machine for rolling power transmission formations in a workpiece, comprising:

a base having a lower end for providing support thereof in an upwardly standing orientation, the base including a pair of spaced base portions and a rear connecting base portion located between the spaced base portions, and the spaced base portions projecting forwardly from the rear connecting base portion to define a vertically extending workspace and having distal front ends remote from the rear connecting base portion;

a lower fluid reservoir, and antivibration mounts that support the lower end of the base on the lower fluid reservoir;

tie rod assemblies that extend horizontally between the spaced base portions to provide securement thereof to the rear connecting base portion and to each other;

a headstock spindle support mounted by the rear connecting base portion;

a tailstock spindle support mounted by the front ends of the spaced base portions and cooperable with the headstock spindle support to rotatably mount the workpiece within the workspace for rotation about a rotational axis of the machine; and a pair of vertically movable slides for respectively mounting a pair of forming racks and being respectively mounted by the spaced base portions on opposite sides of the rotational axis about which the workpiece is rotatably supported such that the forming racks oppose each other and roll power transmission formations in the workpiece during vertical movement in opposite directions.

* * * * *

UNITED STATES PATENT AND TRADEMARK OFFICE

CERTIFICATE OF CORRECTION

PATENT NO : 5,970,768

DATED : October 26, 1999

INVENTOR(S) : James Thomas Killop & Robert E. Roseliep

It is certified that error appears in the above-identified patent and that said Letters Patent is hereby corrected as shown below:

In Claim 1, Column 9, Line 24, change "rotatable" to --rotatably--.

Signed and Sealed this

Second Day of May, 2000

*Attest:*

Q. TODD DICKINSON

*Attesting Officer*

*Director of Patents and Trademarks*